US009868150B2

(12) United States Patent
Hofmann et al.

(10) Patent No.: US 9,868,150 B2
(45) Date of Patent: Jan. 16, 2018

(54) SYSTEMS AND METHODS FOR FABRICATING STRUCTURES INCLUDING METALLIC GLASS-BASED MATERIALS USING LOW PRESSURE CASTING

(71) Applicant: California Institute of Technology, Pasadena, CA (US)

(72) Inventors: Douglas C. Hofmann, Altadena, CA (US); Andrew Kennett, Montrose, CA (US)

(73) Assignee: California Institute of Technology, Pasadena, CA (US)

( * ) Notice: Subject to any disclaimer, the term of this patent is extended or adjusted under 35 U.S.C. 154(b) by 229 days.

(21) Appl. No.: 14/491,618

(22) Filed: Sep. 19, 2014

(65) Prior Publication Data

US 2015/0075744 A1 Mar. 19, 2015

Related U.S. Application Data

(60) Provisional application No. 61/879,820, filed on Sep. 19, 2013.

(51) Int. Cl.

| | |
|---|---|
| ***B22D 18/02*** | (2006.01) |
| ***B22D 18/04*** | (2006.01) |
| ***B22D 18/06*** | (2006.01) |
| ***B22D 25/06*** | (2006.01) |
| ***B22D 30/00*** | (2006.01) |
| ***B22D 17/04*** | (2006.01) |

(52) U.S. Cl.

CPC ..... *B22D 18/04* (2013.01); *B22D 17/04* (2013.01); *B22D 18/02* (2013.01); *B22D 18/06* (2013.01); *B22D 25/06* (2013.01); *B22D 30/00* (2013.01)

(58) Field of Classification Search

CPC ..... B22D 17/04; B22D 18/02; B22D 18/04; B22D 18/06; B22D 25/06; B22D 30/00

USPC ..... 164/47, 63, 65, 113

See application file for complete search history.

(56) References Cited

U.S. PATENT DOCUMENTS 3,529,457 A 9/1970 Bowers
3,986,412 A 10/1976 Farley et al.
(Continued)

FOREIGN PATENT DOCUMENTS

CN 102563006 A 7/2012
DE 102010062089 A1 5/2012
(Continued)

OTHER PUBLICATIONS

Hu et al., "Crystallization Kinetics of the Cu47.5Zr74.5Al5 Bulk Metallic Glass under Continuous and Iso-thermal heating", App. Mech. and Materials, Vols. 99-100, 2011, p. 1052-1058.
(Continued)

*Primary Examiner* — Kevin P Kerns
(74) *Attorney, Agent, or Firm* — KPPB LLP

(57) ABSTRACT

Systems and methods to fabricate objects including metallic glass-based materials using low-pressure casting techniques are described. In one embodiment, a method of fabricating an object that includes a metallic glass-based material includes: introducing molten alloy into a mold cavity defined by a mold using a low enough pressure such that the molten alloy does not conform to features of the mold cavity that are smaller than 100 μm; and cooling the molten alloy such that it solidifies, the solid including a metallic glass-based material.

24 Claims, 16 Drawing Sheets

(56) References Cited

U.S. PATENT DOCUMENTS

| | | | | |
|---|---|---|---|---|
| RE29,989 | E | 5/1979 | Polk | |
| 4,173,393 | A | 11/1979 | Maurer | |
| 4,202,404 | A | 5/1980 | Carlson | |
| 4,711,795 | A | 12/1987 | Takeuchi et al. | |
| 4,810,314 | A | 3/1989 | Henderson et al. | |
| 4,812,150 | A | 3/1989 | Scott | |
| 4,823,638 | A | 4/1989 | Ishikawa et al. | |
| 4,851,296 | A | 7/1989 | Tenhover et al. | |
| 4,883,632 | A | 11/1989 | Goto et al. | |
| 5,168,918 | A * | 12/1992 | Okuda et al. | B22D 21/005 164/495 |
| 5,288,344 | A | 2/1994 | Peker et al. | |
| 5,310,432 | A | 5/1994 | Yamanaka et al. | |
| 5,746,844 | A | 5/1998 | Sterett et al. | |
| 5,772,803 | A | 6/1998 | Peker et al. | |
| 5,896,642 | A | 4/1999 | Peker et al. | |
| 6,162,130 | A | 12/2000 | Masumoto et al. | |
| 6,273,322 | B1 | 8/2001 | Yamamoto et al. | |
| 6,620,264 | B2 | 9/2003 | Kundig et al. | |
| 6,652,679 | B1 | 11/2003 | Inoue et al. | |
| 6,771,490 | B2 | 8/2004 | Peker et al. | |
| 6,843,496 | B2 | 1/2005 | Peker et al. | |
| 6,887,586 | B2 | 5/2005 | Peker et al. | |
| 7,052,561 | B2 | 5/2006 | Lu et al. | |
| 7,073,560 | B2 | 7/2006 | Kang et al. | |
| 7,075,209 | B2 | 7/2006 | Howell et al. | |
| 7,357,731 | B2 | 4/2008 | Johnson et al. | |
| 7,360,419 | B2 | 4/2008 | French et al. | |
| 7,497,981 | B2 | 3/2009 | Graham et al. | |
| 7,500,987 | B2 | 3/2009 | Bassler et al. | |
| 7,552,664 | B2 | 6/2009 | Bulatowicz | |
| 7,862,323 | B2 | 1/2011 | Micarelli et al. | |
| 7,896,982 | B2 | 3/2011 | Johnson et al. | |
| 8,400,721 | B2 | 3/2013 | Bertele et al. | |
| 8,485,245 | B1 | 7/2013 | Prest et al. | |
| 8,596,106 | B2 | 12/2013 | Tang et al. | |
| 8,613,815 | B2 | 12/2013 | Johnson et al. | |
| 8,986,469 | B2 | 3/2015 | Khalifa et al. | |
| 9,057,120 | B2 | 6/2015 | Pham et al. | |
| 9,328,813 | B2 | 5/2016 | Hofmann et al. | |
| 9,610,650 | B2 | 4/2017 | Hofmann et al. | |
| 2002/0053375 | A1 | 5/2002 | Hays et al. | |
| 2002/0100573 | A1 | 8/2002 | Inoue et al. | |
| 2002/0184766 | A1 | 12/2002 | Kobayashi et al. | |
| 2003/0062811 | A1 | 4/2003 | Peker et al. | |
| 2004/0103536 | A1 | 6/2004 | Kobayashi et al. | |
| 2004/0103537 | A1 | 6/2004 | Kobayashi et al. | |
| 2004/0154701 | A1 | 8/2004 | Lu et al. | |
| 2005/0034792 | A1 | 2/2005 | Lu et al. | |
| 2005/0127139 | A1 | 6/2005 | Slattery et al. | |
| 2006/0156785 | A1 | 7/2006 | Mankame | |
| 2007/0034304 | A1 | 2/2007 | Inoue et al. | |
| 2007/0226979 | A1 | 10/2007 | Paton et al. | |
| 2008/0085368 | A1 | 4/2008 | Gauthier et al. | |
| 2008/0121316 | A1 | 5/2008 | Duan et al. | |
| 2009/0011846 | A1 | 1/2009 | Scott | |
| 2009/0114317 | A1 | 5/2009 | Collier et al. | |
| 2009/0194205 | A1 | 8/2009 | Loffler et al. | |
| 2010/0313704 | A1 | 12/2010 | Wang et al. | |
| 2011/0048587 | A1 | 3/2011 | Vecchio et al. | |
| 2011/0302783 | A1 | 12/2011 | Nagata et al. | |
| 2012/0067100 | A1 | 3/2012 | Stefansson et al. | |
| 2012/0073710 | A1 | 3/2012 | Kim et al. | |
| 2012/0077052 | A1 | 3/2012 | Demetriou et al. | |
| 2013/0112321 | A1 | 5/2013 | Poole et al. | |
| 2013/0133787 | A1 | 5/2013 | Kim | |
| 2013/0139964 | A1 | 6/2013 | Hofmann et al. | |
| 2013/0309121 | A1 | 11/2013 | Pres et al. | |
| 2013/0333814 | A1 | 12/2013 | Fleury et al. | |
| 2014/0020794 | A1 | 1/2014 | Hofmann et al. | |
| 2014/0083640 | A1 | 3/2014 | Waniuk et al. | |
| 2014/0093674 | A1 | 4/2014 | Hofmann et al. | |
| 2014/0141164 | A1 | 5/2014 | Hofmann | |
| 2014/0202595 | A1 | 7/2014 | Hofmann | |
| 2014/0213384 | A1 | 7/2014 | Johnson et al. | |
| 2014/0224050 | A1 | 8/2014 | Hofmann et al. | |
| 2014/0227125 | A1 | 8/2014 | Hofmann | |
| 2014/0246809 | A1 | 9/2014 | Hofmann | |
| 2014/0312098 | A1 | 10/2014 | Hofmann et al. | |
| 2014/0342179 | A1 | 11/2014 | Hofmann et al. | |
| 2015/0047463 | A1 | 2/2015 | Hofmann et al. | |
| 2015/0068648 | A1 | 3/2015 | Schroers et al. | |
| 2015/0314566 | A1 | 11/2015 | Mattlin et al. | |
| 2016/0178047 | A1 | 6/2016 | Kennett et al. | |
| 2016/0186850 | A1 | 6/2016 | Hofmann et al. | |
| 2016/0258522 | A1 | 9/2016 | Hofmann et al. | |
| 2016/0361897 | A1 | 12/2016 | Hofmann et al. | |
| 2017/0121799 | A1 | 5/2017 | Hofmann et al. | |

FOREIGN PATENT DOCUMENTS

| | | | |
|---|---|---|---|
| EP | 0127366 | A1 | 5/1984 |
| EP | 1063312 | A1 | 12/2000 |
| EP | 1138798 | A1 | 10/2001 |
| EP | 1696153 | A1 | 8/2006 |
| EP | 1404884 | B1 | 7/2007 |
| EP | 1944138 | A2 | 7/2008 |
| JP | 61276762 | A | 12/1986 |
| JP | 2002045960 | A | 2/2002 |
| JP | 2004353053 | A | 12/2004 |
| WO | 2007038882 | A1 | 4/2007 |
| WO | 2011159596 | A1 | 12/2011 |
| WO | 2014004704 | A1 | 1/2014 |
| WO | 2014058498 | A3 | 4/2014 |
| WO | 2015042437 | A1 | 3/2015 |
| WO | 2015156797 | A1 | 10/2015 |

OTHER PUBLICATIONS

Song et al., "Strategy for pinpointing the formation of B2 CuZr in metastable CuZr-based shape memory alloys", Acta Materialia 59, 2011, 6620-6630.

Wu et al., "Formation of Cu—Zr—Al bulk metallic glass composites with improved tensile properties", Acta Materialia 59, 2011, pp. 2928-2936.

"Corrosion of Titanium and Titanium Alloys", Total Materia. http://www.totalmateria.com/Article24.htm Published Sep. 2001, Accessed Feb. 16, 2016.

Jiang et al., "Low-Density High-Strength Bulk Metallic Glasses and Their Composites: A Review", Advanced Engineering Materials, DOI: 10.1002/adem.201400252, Nov. 19, 2014, pp. 1-20.

International Preliminary Report on Patentability for International Application PCT/US2013/047950, Report completed Dec. 31, 2014, dated Jan. 8, 2015, 7 Pgs.

International Preliminary Report on Patentability for International Application PCT/US2013/050614, report dated Jan. 20, 2015, dated Jan. 29, 2015, 9 Pgs.

International Search Report and Written Opinion for International Application PCT/US2014/033510, report completed Jan. 8, 2015, 2014, dated Jan. 8, 2015, 11 Pgs.

International Search Report and Written Opinion for International Application PCT/US2014/056615, report completed Dec. 29, 2014, dated Dec. 30, 2014, 13 Pgs.

Kim et al., "Weldability of Cu54Zr22Ti18Ni6 bulk metallic glass by ultrasonic welding processing", Materials Letters, 2014, 130, pp. 160-163.

International Preliminary Report on Patentability for International Application No. PCT/US2014/056615, Report Issued Mar. 22, 2016, dated Mar. 31, 2016, 11 Pgs.

Inoue, A. et al., "Recent development and application products of bulk glassy alloys", Acta Materialia, vol. 59, Issue 6, Jan. 20, 2011, 2243-2267.

Nishiyama, N. et al., "Recent progress of bulk metallic glasses for strain-sensing devices", Materials Science and Engineering: A, vols. 449-451, Mar. 25, 2007, 79-83.

Abdeljawad, F. et al., Physical Review Letters, vol. 105, 125503, Sep. 17, 2010.

Cheng, J. L. et al., Intermetallics, vol. 18, Issue 12, Sep. 24, 2010, pp. 2425-2430.

(56) References Cited

OTHER PUBLICATIONS

Fan, C. et al., Applied Physics Letters, vol. 81, Issue 6, Aug. 5, 2002.
Ha, D. J. et al., Materials Science and Engineering: A, vol. 552, May 28, 2012, pp. 404-409.
Harmon, John S. et al., Physical Review Letters, vol. 99, 135502, Sep. 28, 2007.
Hays, C. C. et al., Physical Review Letters, vol. 84, 2901, Mar. 27, 2000.
Hofmann, D. C. et al., Proceedings of the National Academy of Science, vol. 105, Dec. 23, 2008, pp. 20136-20140.
Hofmann, D. C. et al., Material Science Forum, vol. 633-634, 2010, pp. 657-663.
Huang, Y. L. et al., Scripta Materialia, vol. 53, Mar. 29, 2005, pp. 93-97.
Kim, C. P. et al., Scripta Materialia, vol. 65, May 3, 2011, pp. 304-307.
Kuhn, U. et al. Materials Science and Engineering: A, vols. 375-377, 2004, pp. 322-326.
Kuhn, U. et al., Applied Physics Letters, vol. 80, No. 14, Apr. 8, 2002.
Launey, M. E. et al., Applied Physics Letters, vol. 94, 241910, 2009.
Lee, M. L. et al., Acta Materialia, vol. 52, Issue 14, Jun. 17, 2004, pp. 4121-4131.
Narayan, R. L. et al., Scripta Materialia, vol. 63, Issue 7, Jun. 9, 2010, pp. 768-771.
Oh, Y. S. et al., Acta Materialia, vol. 59, Issue 19, Sep. 23, 2011, pp. 7277-7286.
Pauly, S. et al., Nature Materials, vol. 9, Issue 6, May 16, 2010, pp. 473-477.
Qiao, J. W. et al., Materials Science and Engineering: A, vol. 527, Issues 29-30, Aug. 20, 2010, pp. 7752-7756.
Singer, I. L. et al., Wear, vol. 195, Issues 1-2, Jul. 1996, pp. 7-20.
Szuecs, F. et al., Acta Materialia, vol. 49, Issue 9, Feb. 2001, pp. 1507-1513.
Tan, H. et al., Intermetallics, vol. 10, Issues 11-12, Nov. 2002, pp. 1203-1205.
Wu, Hong et al., Transactions of Nonferrous Metals Society of China, vol. 22, Issue 3, Jan. 2012, pp. 585-589.
Zenebe et al., Tribology Letters, vol. 47, Issue 1, Apr. 28, 2012, pp. 131-138.
Zhu, Z. et al., Scripta Materialia, vol. 62, Issue 5, Nov. 18, 2009, pp. 278-281.
International Search Report and Written Opinion for International Application No. PCT/US2013/050614, International Filing Date Jul. 16, 2013, Search Completed May 7, 2014, dated May 7, 2014, 12 pgs.
"Harmonic Drive AG", website, printed from http://harmoncdrive.aero/?idcat=471, Feb. 20, 2014, 2 pgs.
"Harmonic Drive Polymer GmbH", printed Feb. 20, 2014 from http://www.harmonicdrive.de/English/the-company/subsidiaries/harmonic-drive-polymer-gmbh.html, 1 pg.
International Search Report and Written Opinion for International Application PCT/US2013/047950, completed Oct. 8, 2013, 9 pgs.
"Introduction to Thermal Spray Processing", ASM International, Handbook of Thermal Spray Technology (#06994G), 2004, 12 pgs.
Abrosimova et al., "Crystalline layer on the surface of Zr-based bulk metallic glasses", Journal of Non-Crystalline solids, 2001, vol. 288, pp. 121-126.
An et al., "Synthesis of single-component metallic glasses by thermal spray of nanodroplets on amorphous substrates", Applied Physics Letters, 2012, vol. 100, pp. 041909-1-041909-4.
Anstis et al., "A Critical Evaluation of Indentation Techniques for Measuring Fracture Toughness: I, Direct Crack Measurements", Journal of American Ceramic Society, Sep. 1981, vol. 64, No. 8, pp. 533-538.
Ashby et al., "Metallic glasses of structural materials", Scripta Materialia, 2006, vol. 54, pp. 321-326.
Bakkal, "Sliding tribological characteristics of Zr-based bulk metallic glass under lubricated conditions", Intermetallics, 2010, vol. 18, pp. 1251-1253.
Bardt et al., "Micromolding three-dimensional amorphous metal structures", J. Mater. Res, Feb. 2007, vol. 22, No. 2, pp. 339-343.
Basu et al., "Laser surface coating of Fe—Cr—Mo—Y—B—C bulk metallic glass composition on AISI 4140 steel", Surface & Coatings Technology, 2008, vol. 202, pp. 2623-2631.
Boopathy et al., "Near-threshold fatigue crack growth in bulk metallic glass composites", J. Mater. Res., vol. 24, No. 12, pp. 3611-3619.
Branagan et al., "Wear Resistant Amorphous and Nanocomposite Steel Coatings", Met. Mater. Trans. A, 2001, 32A; Idaho National Engineering and Environmental Laboratory, DOI 10.1007/s11661-001-0051-8, 15 pgs.
Cadney et al., "Cold gas dynamic spraying as a method for freeforming and joining materials", Science Direct, Surface & Coatings Technology, 202, 2008, pp. 2801-2806.
Calin et al., "Improved mechanical behavior of Cu-Ti-based bulk metallic glass by in situ formation of nanoscale precipitates", Scripta Materialia, 2003, vol. 48, pp. 653-658.
Chen et al., "Elastic Constants, Hardness and Their Implications to Flow Properties of Metallic Glasses", Journal of Non-crystalline Solids, 1975, vol. 18, pp. 157-171.
Chen et al., "Formation of Micro-Scale Precision Flexures Via Molding of Metallic Glass", Source and date unknown, 4 pgs.
Chen et al., "Influence of laser surface melting on glass formation and tribological behaviors of $Zr_{55}Al_{10}Ni_5Cu_{30}$ alloy", J. Mater Res. Oct. 28, 2011, vol. 26, No. 20, pp. 2642-2652.
Cheng, J. B. "Characterization of mechanical properties of FeCrBSiMnNbY metallic glass coatings", J Mater Sci., 2009, vol. 44, pp. 3356-3363, Apr. 16, 2009.
Choi et al., "Tribological behavior of the kinetic sprayed $Ni_{59}Ti_{16}Zr_{20}Si_2Sn_3$", Journal of Alloys and Compounds, 2007, vol. 434-435, pp. 64-67.
Conner et al., "Shear band spacing under bending of Zr-based metallic glass plates", Acta Materialia, 2004, vol. 52, pp. 2429-2434.
Conner et al., "Shear bands and cracking of metallic glass plates in bending", Journal of Applied Physics, Jul. 15, 2003, vol. 94, No. 2, pp. 904-911.
Dai et al., "A new centimeter-diameter Cu-based bulk metallic glass", Scripta Materialia, 2006, vol. 54, pp. 1403-1408.
Davis, "Hardness/Strength Ratio of Metallic Glasses", Scripta Metallurgica, 1975, vol. 9, pp. 431-436.
De Beer et al., "Surface Folds Make Tears and Chips", Physics, 2012, vol. 100, 3 pgs.
Dislich et al., "Amorphous and Crystalline Dip Coatings Obtained from Organometallic Solutions: Procedures, Chemical Processes and Products", Metallurgical and Protective Coatings, 1981, vol. 77, pp. 129-139.
Duan et al., "Lightweight Ti-based bulk metallic glasses excluding late transition metals", Scripta Materialia, 2008, vol. 58, pp. 465-468.
Duan et al., "Tribological properties of $Zr_{41.25}Ti_{13.75}Ni_{10}Cu_{12.5}Be_{22.5}$ bulk metallic glasses under different conditions", Journal of Alloys and Compounds, 2012, 528. pp. 74-78.
Fleury et al., "Tribological properties of bulk metallic glasses", Materials Science and Engineering, 2004, vol. A375-377, pp. 276-279.
Fornell et al., "Enhanced mechanical properties and in vitro corrosion behavior of amorphous and devitrified $T1_{40}Zr_{10}Cu_{38}Fd_{12}$ metallic glass", Journal of the Mechanical Behavior of Biomedical Materials, 2011, vol. 4, pp. 1709-1717.
Fu et al., "Sliding behavior of metallic glass Part I. Experimental investigations", Wear, 2001, vol. 250, pp. 409-419.
Ganesan et al. "Bonding behavior studies of cold sprayed copper coating on the PVC polymer substrate", Surface & Coatings Technology, 2012, vol. 207, pp. 262-269.
Garrett et al., "Effect of microalloying on the toughness of metallic glasses", Applied Physics Letter, 2012, vol. 101, 241913-1-241913-3.
Gleason Corporation, "Gear Product News", Introducing genesis, The Next Generation in Gear Technology, Apr. 2006, 52 pgs.

(56) References Cited

OTHER PUBLICATIONS

Gloriant, "Microhardness and abrasive wear resistance of metallic glasses and nanostructured composite materials", Journal of Non-Crystalline Solids, 2003, vol. 316, pp. 96-103.
Greer, "Partially or fully devitrified alloys for mechanical properties", Materials and Science and Engineering, 2001, vol. A304, pp. 68-72.
Greer et al., "Wear resistance of amorphous alloys and related materials", International Materials Reviews, 200, vol. 47, No. 2, pp. 87-112.
Hale, "Principles and Techniques for Designing Precision Machines", Ph.D. Thesis, Feb. 1999, 493 pgs.
Haruyama et al., "Volume and enthalpy relaxation in $Zr_{55}Cu_{30}Ni_5Al_{10}$ bulk metallic glass", Acta Materialia, 2010, vol. 59, pp. 1829-1836.
Hejwowski et al., "A comparative study of electrochemical properties of metallic glasses and weld overlay coatings", Vacuum 88 (2013) 118-123.
Hofmann, "Bulk Metallic Glasses and Their Composites: A Brief History of Diverging Fields", Journal of Materials, 2013, vol. 2013, 7 pgs.
Hofmann, "Shape Memory Bulk Metallic Glass Composites", Science, Sep. 10, 2010, vol. 329, pp. 1294-1295.
Hofmann et al., "Designing metallic glass matrix composites with high toughness and tensile ductility", Nature Letters, Feb. 28, 2008, vol. 451, pp. 1085-1090.
Hofmann et al., "Semi-solid Induction Forging of Metallic Glass Matrix Composites", JOM, Dec. 2009, vol. 61, No. 12, pp. 11-17, plus cover.
Hong et al., "Dry sliding tribological behavior of Zr-based bulk metallic glass", Trans. Nonferrous Met. Soc. China, 2012, vol. 22, pp. 585-589.
Hong et al., "Microstructurel characteristics of high-velocity oxygen-fuel (HVOF) sprayed nickel-based alloy coating", Journal of Alloys and Compounds 581 (2013) pp. 398-403.
Huang et al., "Fretting wear behavior of bulk amorphous steel", Intermetallics, 2011, vol. 19, pp. 1385-1389.
Inoue et al., "Cobalt-based bulk glassy alloy with ultrahigh strength and soft magnetic properties", Nature Materials, Oct. 2003, vol. 2, pp. 661-663.
Inoue et al., "Preparation of 16 mm diameter Rod of Amorphous $Zr_{65}Al_{7.5}Ni_{10}Cu_{17.5}$ Alloy", Material Transactions, JIM, 1993, vol. 34, No. 12, pp. 1234-1237.
Ishida et al., "Wear resistivity of super-precision microgear made of Ni-based metallic glass", Materials Science and Engineering, 2007, vol. A449-451, pp. 149-154.
Jiang et al, "Progress in low density bulk metallic glasses and their composites", pp. 1-56.
Jiang et al., "Tribological Studies of a Zr-Based Glass-Forming Alloy with Different States", Advanced Engineering Materials, 2009, vol. 1, No. 11, pp. 925-931.
Kahraman et al., "A Feasibility Study on Development of Dust Abrasion Resistant Gear Concepts for Lunar Vehicle Gearboxes", NASA Grant NNX07AN42G Final Report, Mar. 11, 2009, 77 pgs.
Kim "Amorphous phase formation of Zr-based alloy coating by HVOF spraying process", Journal of Materials Science 36 (2001) pp. 49-54.
Kim et al. "Enhancement of metallic glass properties of Cu-based BMG coating by shroud plasma spraying", Science Direct, Surface & Coatings Technology 205 (2011) pp. 3020-3026.
Kim et al. "Oxidation and crystallization mechanisms in plasma-sprayed Cu-based bulk metallic glass coatings", Acta Materialia. 2010, vol. 58, pp. 952-962.
Kim et al., "Production of $Ni_{65}Cr_{15}P_{16}B_4$ Metallic Glass-Coated Bipolar Plate for Fuel Cell by High Velocity Oxy-Fuel (HVOF) Spray Coating Method", The Japan Institute of Metals, Materials Transactions, vol. 51, No. 9 (2010) pp. 1609-1613.
Kobayasi et al. "Property of Ni-Based Metallic Glass Coating Produced by Gas Tunnel Type Plasma Spraying", International Plasma Chemistry Society, ISPC 20, 234, Philadelphia, USA; Retrieved from: http://www.ispc-conference.org/ispcproc/ispc20/234.pdf.
Kobayashi et al., "Fe-based metallic glass coatings produced by smart plasma spraying process", Materials Science and Engineering, 2008, vol. B148, pp. 110-113.
Kobayashi et al., "Mechanical property of Fe-base metallic glass coating formed by gas tunnel type plasma spraying", ScienceDirect, Surface & Coatings Technology (2007), 6 pgs.
Kong et al., "Effect of Flash Temperature on Tribological Properties of Bulk Metallic Glasses", Tribol. Lett., 2009, vol. 35, pp. 151-158.
Kozachkov et al., "Effect of cooling rate on the volume fraction of B2 phases in a CuZrAlCo metallic glass matrix composite", lmtermetallics, 2013, vol. 39, pp. 89-93.
Kumar et al., "Bulk Metallic Glass: The Smaller the Better", Advanced Materials, 2001, vol. 23, pp. 461-476.
Kwon et al., "Wear behavior of Fe-based bulk metallic glass composites", Journal of Alloys and Compounds, 2011, vol. 509S, pp. S105-S108.
Launey et al., "Solution to the problem of the poor cyclic fatigue resistance of bulk metallic glasses", PNAS Early Edition, pp. 1-6.
Li et al., "Wear behavior of bulk $Zr_{41}Ti_{14}Cu_{12.5}Ni_{10}Be_{22.5}$ metallic glasses", J. Mater. Res., Aug. 2002, vol. 17, No. 8, pp. 1877-1880.
Lillo et al. "Microstructure, Processing, Performance Relationships for High Temperature Coatings", U.S. Department of Energy, Office of Fossil Energy, under DOE Idaho Operations Office, Contract DE-AC07-05ID14517; 22nd Annual Conference on Fossil Energy Materials, Pittsburgh, U.S., 8 pgs.
List et al. "Impact Conditions for Cold Spraying of Hard Metallic Glasses", Journal of Thermal Spray Technology, Jun. 2012, vol. 21, No. 3-4, pp. 531-540.
Liu, "Microstructure and properties of Fe-based amorphous metallic coating produced by high velocity axial plasma spraying", Science Direct, Journal of Alloys and Compounds 484 (2009) pp. 300-307.
Liu et al., "Influence of Heat Treatment on Microstructure and Sliding Wear of Thermally Sprayed Fe-Based Metallic Glass coatings", Tribol. Lett., 2012, vol. 46, pp. 131-138.
Liu et al., "Metallic glass coating on metals plate by adjusted explosive welding technique", Applied Surface Science, 2009, vol. 255, pp. 9343-9347.
Liu et al., "Sliding Tribological Characteristics of a Zr-based Bulk Metallic Glass Near the Glass Transition Temperature", Tribol. Lett. 2009, vol. 33, pp. 205-210.
Liu et al., "Wear behavior of a Zr-based bulk metallic glass and its composites", Journal of Alloys and Compounds, 2010, vol. 503, pp. 138-144.
Lupoi et al. "Deposition of metallic coatings on polymer surfaces using cold spray", Science Direct, Surface & Coatings Technology 205 (2010) pp. 2167-2173.
Ma et al., "Wear resistance of Zr-based bulk metallic glass applied in bearing rollers", Materials Science and Engineering, 2004, vol. A386, pp. 326-330.
Maddala et al., "Effect of notch toughness and hardness on sliding wear of $Cu_{50}Hf_{41.5}A_{18.5}$ bulk metallic glass", Scripta Materialia, 2011, vol. 65, pp. 630-633.
Ni, "High performance amorphous steel coating prepared by HVOF thermal spraying", Journal of Alloys and Compounds 467 (2009) pp. 163-167.
Parlar et al., "Sliding tribological characteristics of Zr-based bulk metallic glass", Intermetallics, 2008, vol. 16, pp. 34-41.
Pauly et al., "Modeling deformation behavior of Cu—Zr—Al bulk metallic glass matrix composites", Applied Physics Letters, 2009, vol. 95, pp. 101906-1-101906-3.
Ponnambalam et al., "Fe-based bulk metallic glasses with diameter thickness larger than one centimeter", J Mater Res, 2004. vol. 19; pp. 1320-1323.
Porter et al., "Incorporation of Amorphous Metals into MEMS for High Performance and Reliability", Rockwell Scientific Company, Final Report, Nov. 2003, 41 pgs.
Prakash et al., "Sliding wear behavior of some Fe-, Co-and Ni-based metallic glasses during rubbing against bearing steel", Tribology Letters, 2000, vol. 8, pp. 153-160.

(56) References Cited

OTHER PUBLICATIONS

Ramamurty et al., "Hardness and plastic deformation in a bulk metallic glass", Acta Materialia, 2005, vol. 53, pp. 705-717.
Revesz, A. et al. "Microstructure and morphology of Cu—Zr—Ti coatings produced by thermal spray and treated by surface mechanical attrition", ScienceDirect, Journal of Alloys and Compounds 509S (2011) S482-S485.
Rigney et al., "The Evolution of Tribomaterial During Sliding: A Brief Introduction", Tribol. Lett, 2010, vol. 39, pp. 3-7.
Roberts et al., "Cryogenic Charpy impact testing of metallic glass matrix composites", Scripta Materialia, 2011, 4 pgs.
Schuh et al., "A survey of instrumented indentation studies on metallic glasses", J. Mater. Res., Jan. 2004, vol. 19, No. 1, pp. 46-57.
Segu et al., "Dry Sliding Tribological Properties of Fe-Based Bulk Metallic Glass", Tribol. Lett., 2012, vol. 47, pp. 131-138.
Shen et al., "Exceptionally high glass-forming ability of an FeCoCrMoCBY alloy", Applied Physics, 2005, vol. 86, pp. 151907-1-151907-3.
Sundaram et al., "Mesoscale Folding, Instability, and Disruption of Laminar Flow in Metal Surfaces", Physical Review Letters, Sep. 7, 2012, vol. 109, pp. 106001-1-106001-5.
Tam et al., "Abrasion resistance of Cu based bulk metallic glasses", Journal of Non-Crystalline Solids, 2004, vol. 347, pp. 268-272.
Tam et al., "Abrasive wear of $Cu_{60}Zr_{30}Ti_{10}$ bulk metallic glass", Materials Science and Engineering, 2004, vol. A384 pp. 138-142.
Tao et al., "Effect of rotational sliding velocity on surface friction and wear behavior in Zr-based bulk metallic glass", Journal of Alloys and Compounds, 2010, vol. 492, pp. L36-L39.
Tao et al., "Influence of isothermal annealing on the micro-hardness and friction property in CuZrAl bulk metallic glass", Advanced Materials Research, 2011, vols. 146-147, pp. 615-618.
Tobler et al., "Cryogenic Tensile, Fatigue, and Fracture Parameters for a Solution-Annealed 18 Percent Nickel Maraging Steel", Journal of Engineering Materials and Technology, Apr. 1978, vol. 100, pp. 189-194.
Wagner, "Mechanical Behavior of 18 Ni 200 Grade Maraging Steel at Cyrogenic Temperatures", J Aircraft, Oct. 1986, vol. 23, No. 10, pp. 744-749.
Wang et al., "Progress in studying the fatigue behavior of Zr-based bulk-metallic glasses and their composites", Intermetallics, 2009, vol. 17, pp. 579-590.
Wikipedia, "Harmonic Drive", printed Feb. 20, 2014, 4 pgs.
Wu et al., "Bulk Metallic Glass Composites with Transformation-Mediated Work-Hardening and Ductility", Adv. Mater., 2010, vol. 22, pp. 2770-2773.
Wu et al., "Effects of environment on the sliding tribological behaviors of Zr-based bulk metallic glass", Intermetallics, 2012, vol. 25, 115-125.
Yin et al. "Microstructure and mechanical properties of a spray-formed Ti-based metallic glass former alloy", ScienceDirect, Journal of Alloys and Compounds 512 (2012) 241-245.
Zachrisson et al., "Effect of Processing on Charpy impact toughness of metallic glass matrix composites", J. Mater. Res., May 28, 2011, vol. 26, No. 10, pp. 1260-1268.
Zhang et al., "Abrasive and corrosive behaviors of Cu—Zr—Al—Ag—Nb bulk metallic glasses", Journal of Physics: Conference Series, 2009, vol. 144, pp. 1-4.
Zhang et al., "Robust hydrophobic Fe-based amorphous coating by thermal spraying", Appl. Phys. Lett. 2012, vol. 101, pp. 121603-1-121603-4.
Zhang et al., "Wear behavior of a series of Zr-based bulk metallic glasses", Materials Science and Engineering, 2008, vol. A475, pp. 124-127.
Zhou et al., "Microstructure and Electrochemical Behavior of Fe-Based Amorphous Metallic Coatings Fabricated by Atmospheric Plasma Spraying", Journal of Thermal Spray Technology, Jan. 2011, vol. 20, No. 1-2, pp. 344-350.
Zhuo, "Spray formed Al-based amorphous matrix nanocomposite plate", ScienceDirect, Journal of Alloys and Compounds 509 (2011) L169-L173.
International Preliminary Report on Patentability for International Application PCT/US2014/033510, Report dated Oct. 12, 2016, dated Oct. 20, 2016, 9 Pgs.
"Gear", Dictionary.com. Accessed Aug. 30, 2016.
"Group 4 element", Wkipedia. https://en.wikipedia.org/wiki/Group_4_element, Published Jun. 11, 2010, Accessed Aug. 24, 2016.
Nishiyama et al., "Development and applications of late transition metal bulk metallic glasses", Bulk Metallic Glasses. pp. 1-25. 2008.
Zhang et al., "Developments and applications of bulk metallic glasses", Rev. Adv. Mater. Sci. 18 (2008) 1-9.
Demetriou et al., "Glassy steel optimized for glass-forming ability and toughness", Applied Physics Letters, Jul. 31, 2009, vol. 95, pp. 041907-1-041907-3; http:/idx.doi.org/10.1063/1.3184792.
Lee et al., "Nanomechanical properties of embedded dendrite phase and its influence on inelastic deformation of Zr55Al10Ni5Cu30 glassy alloy", Materials Science and Engineering A, Mar. 25, 2007, vol. 375, pp. 945-948.
Wu, Y. et al., Advanced Materials, Apr. 26, 2010, vol. 22, p. 2270-2773.

* cited by examiner

SYSTEMS AND METHODS FOR FABRICATING STRUCTURES INCLUDING METALLIC GLASS-BASED MATERIALS USING LOW PRESSURE CASTING

CROSS-REFERENCE TO RELATED APPLICATIONS

The current application claims priority to U.S. Provisional Application No. 61/879,820, filed Sep. 19, 2013, the disclosure of which is incorporated herein by reference.

STATEMENT OF FEDERAL FUNDING

The invention described herein was made in the performance of work under a NASA contract, and is subject to the provisions of Public Law 96-517 (35 U.S.C. 202) in which the Contractor has elected to retain title.

FIELD OF THE INVENTION

The present invention generally relates to fabricating structures including metallic glass-based materials using low pressure casting techniques.

BACKGROUND

Metallic glasses, also known as amorphous alloys, embody a relatively new class of materials that is receiving much interest from the engineering and design communities. Metallic glasses are characterized by their disordered atomic-scale structure in spite of their metallic constituent elements—i.e. whereas conventional metallic materials typically possess a highly ordered atomic structure, metallic glass materials are characterized by their disordered atomic structure. Notably, metallic glasses typically possess a number of useful material properties that can allow them to be implemented as highly effective engineering materials. For example, metallic glasses are generally much harder than conventional metals, and are generally tougher than ceramic materials. They can also be relatively corrosion resistant, and, unlike conventional glass, they can have good electrical conductivity. Importantly, the manufacture of metallic glass materials lends itself to relatively easy processing in certain respects. For example, the manufacture of a metallic glass can be compatible with an injection molding process.

Nonetheless, the manufacture of metallic glasses presents challenges that limit their viability as engineering materials. For example, metallic glasses are typically formed by raising a metallic alloy above its melting temperature, and rapidly cooling the melt to solidify it in a way such that its crystallization is avoided, thereby forming the metallic glass. The first metallic glasses required extraordinary cooling rates, e.g. on the order of $10^6$ K/s, and were thereby limited in the thickness with which they could be formed. Indeed, because of this limitation in thickness, metallic glasses were initially limited to applications that involved coatings. Since then, however, particular alloy compositions that are more resistant to crystallization have been developed, which can thereby form metallic glasses at much lower cooling rates, and can therefore be made to be much thicker (e.g. greater than 1 mm). These metallic glasses that have compositions that can allow them to be made to be thicker are known as 'bulk metallic glasses' ("BMGs").

In addition to the development of BMGs, 'bulk metallic glass matrix composites' (BMGMCs) have also been developed. BMGMCs are characterized in that they possess the amorphous structure of BMGs, but they also include crystalline phases of material within the matrix of amorphous structure. For example, the crystalline phases can exist in the form of dendrites. The crystalline phase inclusions can impart a host of favorable materials properties on the bulk material. For example, the crystalline phases can allow the material to have enhanced ductility, compared to where the material is entirely constituted of the amorphous structure. BMGs and BMGMCs can be referred to collectively as BMG-based materials. Similarly, metallic glasses, metallic glasses that include crystalline phase inclusions, BMGs, and BMGMCs can be referred to collectively as metallic glass-based materials or MG-based materials.

SUMMARY OF THE INVENTION

Systems and methods in accordance with embodiments of the invention fabricate objects including metallic glass-based materials using low-pressure casting techniques. In one embodiment, a method of fabricating an object that includes a metallic glass-based material includes: introducing molten alloy into a mold cavity defined by a mold using a low enough pressure such that the molten alloy does not conform to features of the mold cavity that are smaller than 100 μm; and cooling the molten alloy such that it solidifies, the solid including a metallic glass-based material.

In another embodiment, the mold cavity is characterized by extrusion symmetry.

In yet another embodiment, the entirety of the solid includes a metallic glass-based material.

In still another embodiment, only some portion less than the entirety of the solid includes a metallic glass-based material.

In still yet another embodiment, cooling jets are used to cool the molten alloy such that it solidifies.

In a further embodiment, introducing the molten alloy into the mold cavity includes using gas to force the molten alloy into the mold cavity.

In a still further embodiment, introducing the molten alloy into the mold cavity includes using at least a partial vacuum to cause a pressure differential that causes the molten alloy to be drawn into the mold cavity.

In a yet further embodiment, introducing the molten alloy into the mold cavity includes using a hydraulic ram to apply pressure to the molten alloy and thereby introduce it into the mold cavity.

In a still yet further embodiment, introducing the molten alloy into the mold cavity includes pouring molten alloy into the mold cavity.

In another embodiment, introducing the molten alloy into the mold cavity further includes using at least a partial vacuum to cause a pressure differential that causes the molten alloy to be drawn into the mold cavity.

In still another embodiment, introducing the molten alloy into the mold cavity further includes using a piston to apply a force to the molten alloy causing the molten alloy to be compelled into the mold cavity.

In yet another embodiment, the mold cavity defines the shape of a gear.

In still yet another embodiment, a method of fabricating an object that includes a metallic glass-based material includes: introducing molten alloy into a mold cavity defined by a mold using a pressure of less than approximately 100 psi; and cooling the molten alloy such that it solidifies, the solid including a metallic glass-based material.

In a further embodiment, the molten alloy is introduced into the mold cavity at a pressure of less than approximately 15 psi.

In a yet further embodiment, the molten alloy is introduced into the mold cavity at a pressure of less than approximately 5 psi.

In a still further embodiment, the mold cavity is characterized by extrusion symmetry.

In a still yet further embodiment, the entirety of the solid includes metallic glass-based material.

In another embodiment, only some portion less than the entirety of the solid includes a metallic glass-based material.

In yet another embodiment, cooling jets are used to cool the molten alloy.

In still another embodiment, introducing the molten alloy into the mold cavity includes using gas to force the molten alloy into the mold cavity.

In still yet another embodiment, introducing the molten alloy into the mold cavity includes using at least a partial vacuum to cause a pressure differential that causes the molten alloy to be drawn into the mold cavity.

In a further embodiment, introducing the molten alloy into the mold cavity includes using a hydraulic ram to apply pressure to the molten alloy and thereby introduce it into the mold cavity.

In a yet further embodiment, introducing the molten alloy into the mold cavity includes pouring molten alloy into the mold cavity.

DETAILED DESCRIPTION

Turning now to the drawings, systems and methods for fabricating objects including a metallic glass-based material using low pressure casting techniques are illustrated.

While metallic glass-based materials are characterized by a host of desirable materials properties, it has proved to be challenging to economically fabricate objects that include metallic glass-based materials so as to harness their desirable materials properties. For example, although molten metallic glass compositions can be cast into molds to form them into desired shapes, using conventional casting techniques can result in a number of imperfections in the cast part. Thus, for example, in accordance with many conventional casting techniques, molten alloy is forced into a mold cavity at relatively high pressure (e.g. greater than approximately 10,000 psi); as a result, after the material cools, the solidified material may replicate the microscale features that can be unintentionally present in the mold—e.g. the roughness embodied in the surface finish of the mold. For example, if the mold has a rough surface finish, that rough surface can be unintentionally replicated on the solidified material because of the high pressure under which the material is cast. This can be undesirable in a number of respects. For example, a rough surface can be detrimental to the cast part's operation. For instance, where gears are fabricated, a rough surface finish can exacerbate the detrimental effects of 'wear and tear' as compared to what the gear would experience if it had a smoother surface finish.

Figure 1:
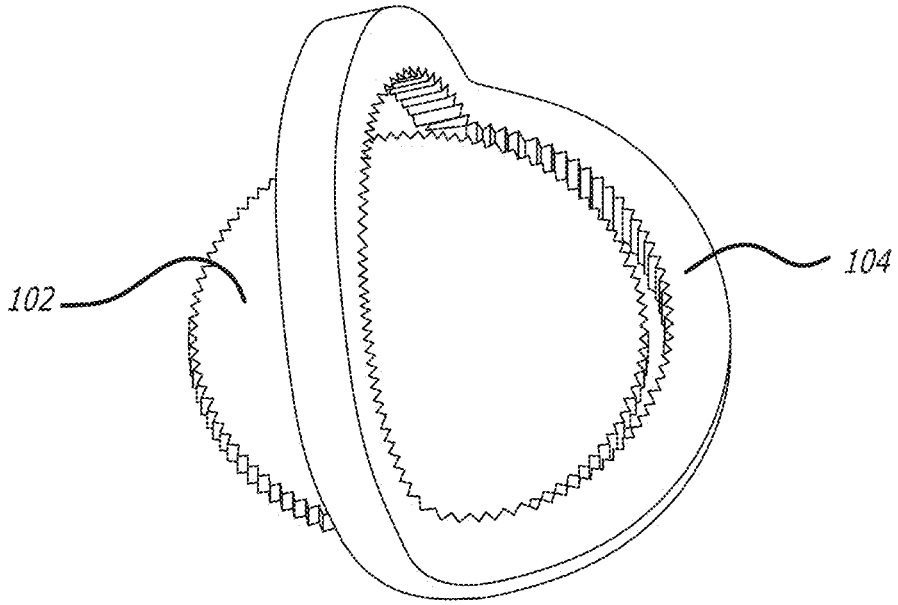
FIG. 1 (Prior Art)
FIG. 1 illustrates how conventional high-pressure casting techniques can cause a metallic glass-based material to adhere to a mold to such an extreme extent that removing the material from the mold causes the destruction of the mold.

Furthermore, casting molten alloys at high pressures, as is conventionally done, can cause other undesired outcomes. For example, in many instances the solidified material will be so tightly adhered to the mold that it will be difficult to remove. The mechanics of this outcome are generally understood to be as follows: when molten alloy is introduced at high pressure, the molten alloy can be compelled to conform to, and/or intertwine with, the rough features of the surface of the mold such that when the melt solidifies, it interlocks with the mold surface to an extent that makes the removal of the cast part from the mold difficult. In many instances, removing a part cast under high pressure from a mold results in damage to the part, the mold, or both. For example, FIG. 1 depicts a cast gear that was so intertwined with the mold that removing the gear from the mold resulted in destruction of the mold. In particular, it is illustrated that in order to remove the cast gear 102 from its mold 104, the mold 104 had to be bent. As a result, the mold was no longer usable. As can be appreciated, destroying molds in order to retrieve cast parts can substantially hinder fabrication process efficiency.

Figure 2A:
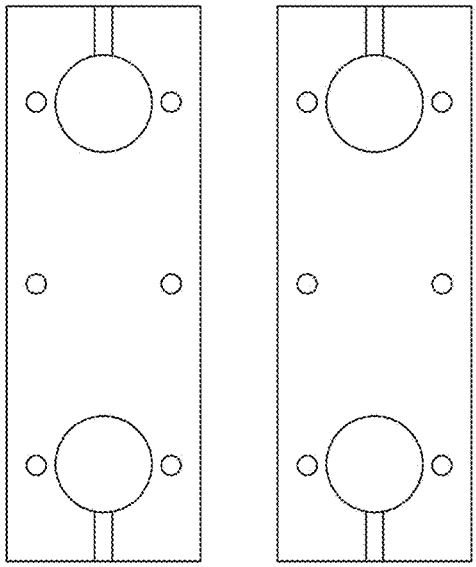
FIG. 2A (Prior Art)
FIGS. 2A-2B illustrate a prior art split mold and how a part cast from the split mold can undesirably include a parting line defined by the mold halves.
Figure 2B:
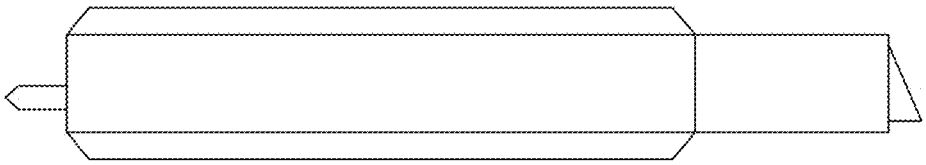
FIG. 2B (Prior Art)

To circumvent this outcome, split molds are often used; split molds can facilitate the removal of the cast part from the mold. However, where split molds are used, the pressurized molten alloy often conforms to the parting line, and consequently, the cast part includes the parting line. For example, FIGS. 2A and 2B illustrate the use of a split mold and how it can result in an undesired parting line. In particular, FIG. 2A illustrates a split mold, and FIG. 2B illustrates a how a part cast from the split mold undesirably includes a parting line that is defined by the adjoining of the two mold halves. As can be appreciated, all of these imperfections limit the viability of using conventional casting techniques to cast parts from metallic glass-based materials, and thereby discourage the use of metallic glass-based materials as viable engineering materials, notwithstanding their desirable materials properties. These imperfections can be addressed with further processing steps (e.g. machining away parting lines), but these further processing steps may still be considered overly burdensome.

Thus, in many embodiments of the invention, molten alloy is cast into molds at low pressures to avoid the aforementioned undesired outcomes, and is thereafter cooled so as to form a casting that includes a metallic glass-based material. For example, in many embodiments, a molten alloy is cast into a mold at a low enough pressure such that the alloy adopts the macroscale geometry of the mold cavity, but does not replicate the microscale features of the mold cavity. This casting method can result in a host of advantages. For instance, the surface finish of the cast part can be largely a function of the surface tension of the molten alloy rather than the surface roughness of the mold. Moreover, because the molten alloy is not being so forcefully compressed against the surface of the mold, as the molten alloy cools—and correspondingly shrinks in volume—it can more easily retract from the surface of the mold. As a result, the solidified part can be more easily removed from the mold. Consequently, split molds do not necessarily have to be used. Further, as can be appreciated, the extent of any post-casting processing to finish the desired part can generally be reduced.

Low-pressure casting techniques are now discussed below in greater detail.

Low-Pressure Casting Techniques

Figure 3:
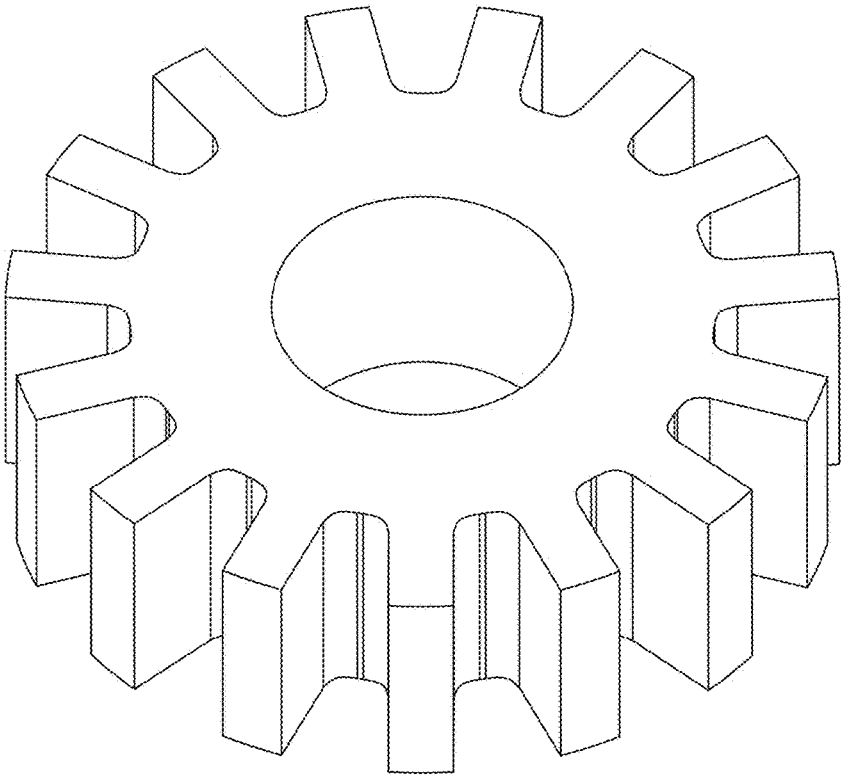
FIG. 3 (Prior Art)
FIG. 3 illustrates a prior art microscale gear.

In many embodiments of the invention, low pressure casting techniques are implemented to fabricate structures. As alluded to previously, although metallic glass based materials can be made to possess a host of desirable materials properties, their practicable implementation as a viable engineering material has yet to be fully realized. This is partly due to an incomplete understanding of the materials properties that metallic glass-based materials can be made to possess. For example, although metallic glass-based materials have been used in the construction of microscale gears, progress has been slow in manufacturing such gears at a macroscale. U.S. Pat. Pub. No. 2015/0047463 entitled "Systems and Methods for Implementing Bulk Metallic Glass based Macroscale Gears" to Hofmann et al. discusses this problem and discloses a strategy for the viable manufacture of macroscale metallic-glass based gears. The disclosure of U.S. Pat. Pub. No. 2015/0047463 is hereby incorporated by reference in its entirety, especially as it pertains to the manufacture of macroscale gears. By way of example, FIG. 3 depicts a metallic glass-based microscale gear that has been fabricated in accordance with prior art techniques. In particular, it is depicted that the gear has teeth on the order of 50 μm in length. Hofmann et al. also discuss particularly robust metallic glass-based material compositions in U.S. Pat. Pub. No. US 2014/0093674 that can be implemented in a wide variety of scenarios. The disclosure of U.S. Pat. Pub. No. US 2014/0093674 is hereby incorporated by reference in its entirety, especially as it pertains to metallic-glass based materials having a composition that includes copper, zirconium, titanium, hafnium, and/or rutherfordium.

Hofmann et al. further disclose that metallic glass-based materials can be made to be particularly well-suited in the manufacture of compliant mechanisms in U.S. Pat. Pub. No. US 2014/0020794. The disclosure of U.S. Pat. Pub. No. US 2014/0020794 is hereby incorporated by reference in its entirety, especially as it pertains to compliant mechanisms that include metallic glass-based materials. Moreover, Hofmann et al. further disclose that metallic glass-based materials can be made to be particularly well suited in the manufacture of strain wave gears in U.S. Pat. Pub. No. US 2014/0224050. The disclosure of U.S. Pat. Pub. No. US 2014/0020794 is hereby incorporated by reference in its entirety, especially as it pertains to strain wave gears and strain wave gear components that include metallic glass-based materials.

In addition to disclosing metallic glass-based material compositions that more easily lend themselves as viable engineering materials, and particular components that can demonstrate improved performance when fabricated from metallic-glass based materials, Hofmann et al. have further disclosed particular fabrication techniques that can more easily enable any of a variety of geometries to be fabricated from metallic glass-based materials. For example, Hofmann et al. disclose depositing metallic glass-based compositions in a layer-by-layer manner (e. g., akin to additive manufacturing techniques) to build up a desired geometry in U.S. Pat. Pub. No. US 2014/0202595. The disclosure of U.S. Pat. Pub. No. US 2014/0202595 is hereby incorporated by reference in its entirety, especially as it pertains to depositing metallic glass based material compositions in a layer-by-layer manner. Similarly, Hofmann et al. disclose using ultrasonic consolidation to adjoin ribbons of metallic glass-based material compositions and to thereby build up a desired geometry in U.S. Pat. Pub. No. 2014/0312098. The disclosure of U.S. Pat. Pub. No. 2014/0312098 is hereby incorporated by reference in its entirety, especially as it pertains to using ultrasonic consolidation to adjoin ribbons of metallic glass-based material compositions to thereby build up a desired geometry. Hofmann et al. further disclose techniques for coating objects with metallic glass-based materials in U.S. Pat. Pub. No. US 2014/0141164. The disclosure of U.S. Pat. Pub. No. US 2014/0141164 is hereby incorporated by reference in its entirety, especially as it pertains to coating objects with metallic glass-based materials.

Figure 4:
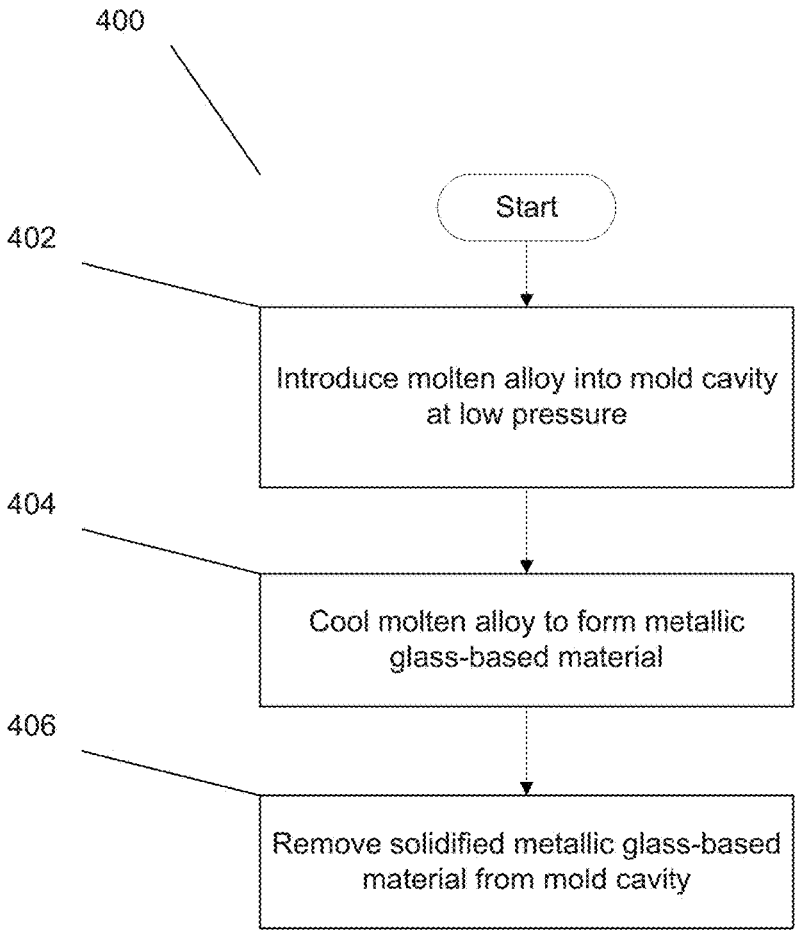
FIG. 4 illustrates a process for fabricating a metallic glass-based component using a low-pressure casting technique in accordance with an embodiment of the invention.

Notably, as discussed above, metallic glass-based materials can be implemented using heritage conventional casting techniques. However, as also mentioned above, the heritage casting techniques can result in a number of deficiencies. Accordingly, in many embodiments of the invention, low pressure-casting techniques are implemented that help circumvent the above-identified issues. For example, FIG. 4 illustrates a method of fabricating an object using a low pressure casting technique in accordance with an embodiment of the invention. In particular, the method 400 includes introducing 402 molten alloy into a mold cavity at a low pressure, cooling 404 the molten alloy to form an object that includes a metallic glass-based material, and removing 406 the cast object. In many embodiments, the pressure under which molten alloy is introduced 402 into the mold is such that the surface finish of the cast part is largely governed by the surface tension of the melt. In numerous embodiments, the pressure under which the molten alloy is introduced 402 into the mold is such that the molten alloy does not conform to features of the mold that are less than approximately 100 μm in length. Thus, any rough features that are present on the inner surface of the mold are not replicated on the cast part. In a number of embodiments, the pressure under which the molten alloy is introduced 402 is less than approximately 100 psi. In several embodiments, the pressure under which the molten alloy is introduced 402 is less than approximately 15 psi. Although, several metrics have been measured to characterize the low pressure under which molten alloy is introduced into the cavity, it should be clear that any suitable pressure that achieves the specified desired benefits—e.g. achieving a smooth surface finish, avoiding replicating the microfeatures of the mold surface, and/or avoiding the interlocking of the cast part with the mold thereby allowing the cast part to be easily retrieved from the mold—can be implemented in accordance with many embodiments of the invention. The molten alloy may then be cooled 404 so as to form a cast part that includes metallic glass-based material. The cast part may then be removed 406 from the mold.

As can be appreciated, introducing the molten alloy at low pressures can avoid undesirably replicating the rough surface finish of a mold onto a cast part. Additionally, introducing the molten alloy at low pressure instead of high pressure allows the solidified cast part to be more easily removed from the mold. For example, as discussed above, when molten alloy is introduced at high pressure, it can undesirably intertwine with the surface of the mold, thereby making it difficult to remove from the mold. By contrast, using the low pressure casting techniques described herein, the cast part can be cast so as not to interlock with the mold surface to such an extent that it becomes difficult to remove. Moreover, as the cast part cools, the molten alloy composition can be such that its cooling causes it to shrink in volume, which can allow it to be more easily removed 406 from the mold.

The molten alloy can be cooled 404 using any suitable technique. As can be appreciated, the extent to which the molten alloy develops an amorphous structure is largely a function of the rate that the molten alloy cools. Thus for instance, in many embodiments, cooling jets are used to rapidly cool the molten alloy such that metallic glass forms. Of course, it should be clear that any of a variety of techniques may be used to cool the molten alloy so as to cause the formation of metallic glass. In many embodiments, the molten alloy is cooled so rapidly that the entire casting is characterized by an amorphous structure. In several embodiments, the molten alloy is cooled to an extent such that it only partially forms an amorphous structure.

In many instances the mold in which the molten alloy is cast is characterized by extrusion symmetry. In other words, the mold geometry has a similar cross-section throughout its length. For example, in many embodiments, the mold geometry is cylindrical. In some embodiments, the geometry of the mold cavity defines a rectangular prism. Having extrusion symmetry can allow the cast part to be easily ejected from the mold—e.g. the cast part can be ejected along its longitudinal axis. Note that split molds need not necessarily be used where the mold is characterized by extrusion symmetry.

Figure 5:
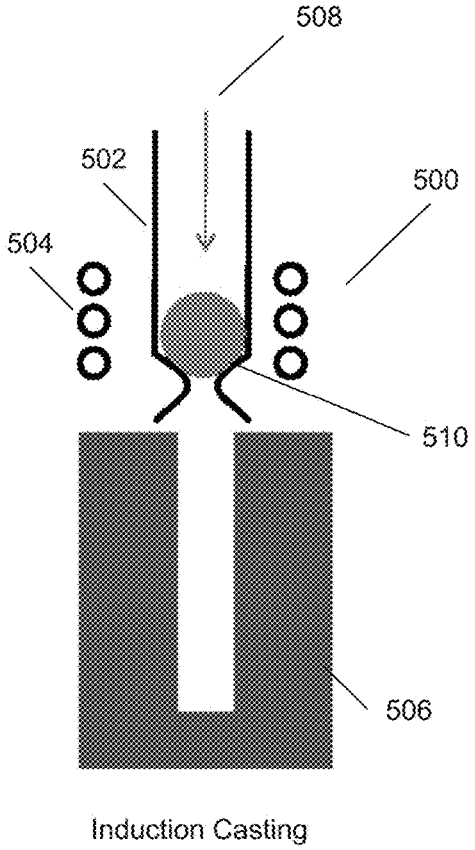
FIG. 5 illustrates an induction casting technique that can be implemented in accordance with an embodiment of the invention.

As can be appreciated, the above described process is compatible with any of a variety of casting techniques. For example, FIG. 5 depicts how induction casting can be used to implement the above-described low pressure casting method. In particular, FIG. 5 depicts an induction casting arrangement 500 that includes a quartz tube 502 through which molten alloy 510 that is capable of forming a metallic glass-based material is introduced into the mold cavity, induction coils 504 that heat the molten alloy 510 so that it can develop a viscosity that allows it to conform to the shape of the mold cavity, a mold 506 that shapes the molten alloy 510. Gas 508 is used to force the molten alloy 510 into the mold 506. As can be appreciated the gas can be applied such that the molten alloy 510 is introduced into the mold 506 at a relatively low pressure as described above (e.g. such that the surface tension of the melt largely governs the surface finish of the cast part; such that the melt does not conform to any features within the mold that are longer than 100 μm in length; and/or such that the melt is introduced at a pressure less than approximately 100 psi). Note that although separate cooling mechanisms/techniques are not illustrated, it should be clear that they can be implemented to rapidly cool the melt so that it forms a metallic glass-based material in accordance with embodiments of the invention.

Figure 6:
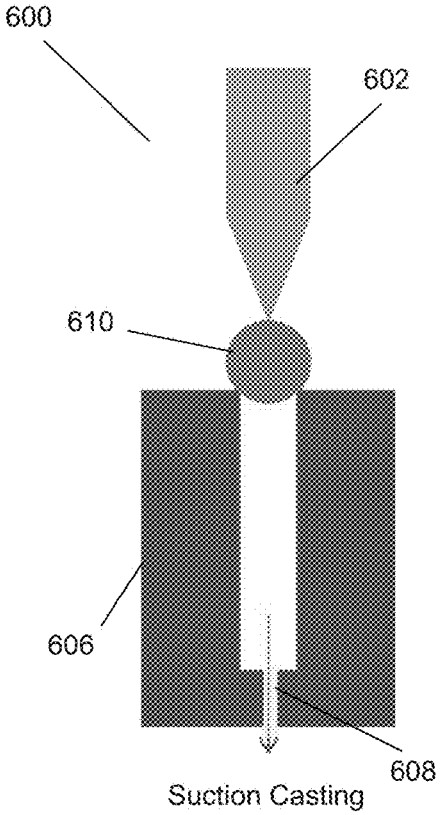
FIG. 6 illustrates a suction casting technique that can be implemented in accordance with an embodiment of the invention.

Similarly, FIG. 6 depicts how a suction casting can be used to implement low pressure casting techniques in accordance with an embodiment of the invention. In particular, FIG. 6 depicts a suction casting arrangement 600 that includes an arc welder 602, a mold 606, and a connection to vacuum 608 (or at least a partial vacuum). In essence, the arc welder 602 heats the molten alloy 610 that can be made to form a metallic glass-based material so that it develops a viscosity and can conform to the shape of the mold cavity. The connection to vacuum 608 gives rise to the pressure differential that causes the molten alloy 610 to conform to the mold cavity. As can be appreciated, this technique can be used to implement the above-described low pressure casting techniques. Additionally, as before, although not illustrated, it can be appreciated that separate cooling techniques/mechanisms can be implemented so as to facilitate the cooling of the melt.

Figure 7:
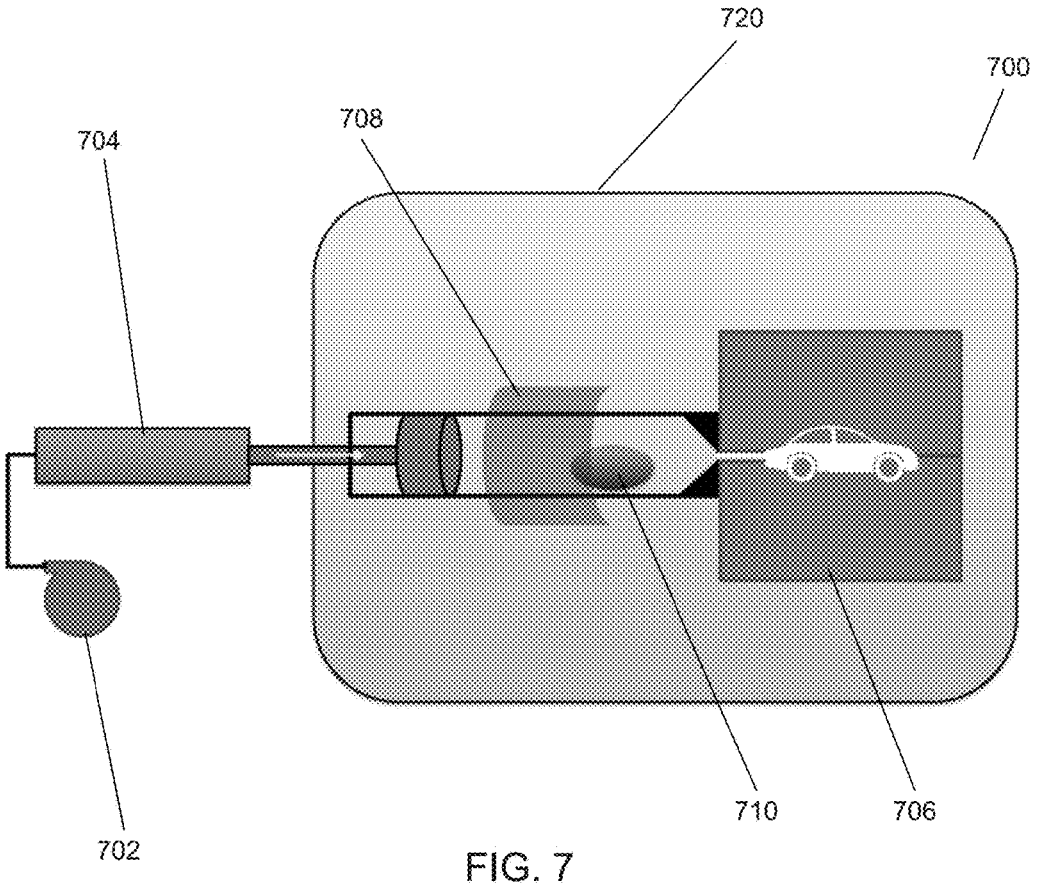
FIG. 7 illustrates a die casting technique that can be implemented in accordance with an embodiment of the invention.

FIG. 7 depicts yet another casting technique that can be used to implement low pressure casting techniques in accordance with an embodiment of the invention. In particular, FIG. 7 depicts an injection casting arrangement 700 that includes a pump 702, a hydraulic ram 704, an induction coil 708 to heat the molten alloy 710 that is capable of forming metallic-glass based material so that it develops a viscosity that can allow it to conform to the shape of a mold cavity, and a mold 706. Further, in many instances, this process is conducted within a vacuum chamber 720. As can be gleaned from the illustration, the hydraulic ram 704 can be used to apply a pressure to the molten alloy 710 so that it conforms to the shape of the mold cavity defined by the mold 706. As can be appreciated, the hydraulic ram can allow the molten alloy 710 to be introduced in to the mold cavity at a relatively reduced pressure in accordance with embodiments of the invention. Again, as before, any of a variety of cooling mechanisms can be used to facilitate the cooling of the melt.

Figure 8:
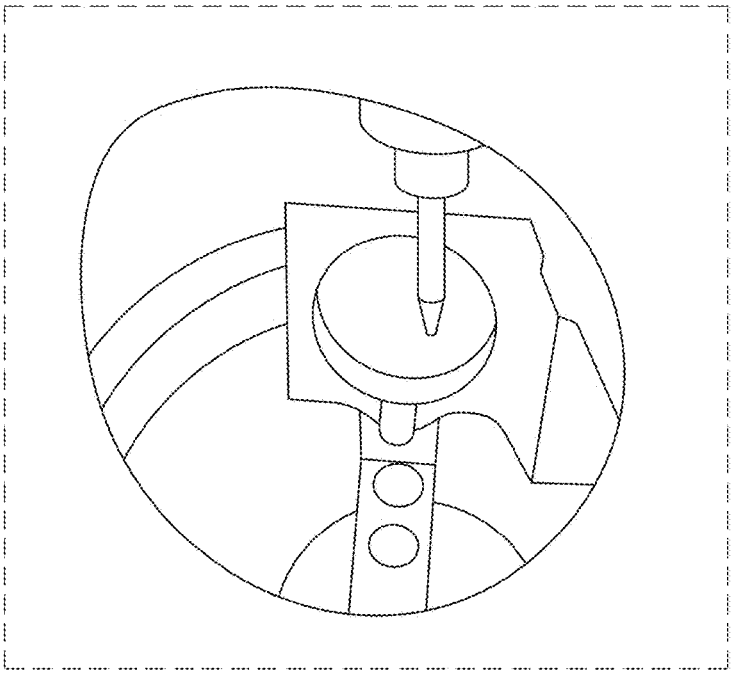
FIG. 8 illustrates a tilt casting technique that can be implemented in accordance with an embodiment of the invention.

FIG. 8 depicts yet another technique that can be used to implement the described low pressure casting techniques. In particular, FIG. 8 depicts tilt casting whereby molten metallic glass-based material is poured into a mold. In many instances, vacuum pressure and/or piston pressure (e.g. injection casting) is used to facilitate tilt casting—e.g. helping draw the molten alloy into the mold cavity. As can be appreciated, tilt casting can be used to implement the described low pressure casting techniques.

While several particular casting methods are discussed, it should be clear that the described low pressure casting techniques can be implemented using any of a variety of arrangements. Generally, low pressure casting techniques in accordance with many embodiments of the invention can be implemented using any arrangement that is capable of introducing molten alloy into a mold at a low pressure (e.g. such that the surface tension of the melt largely governs the surface finish of the cast part; such that the melt does not conform to any features within the mold that are longer than 100 μm in length; and/or such that the melt is introduced at a pressure less than approximately 100 psi), and cooling the melt so as to form a metallic glass-based material. The techniques are not limited to implementation by the above-described arrangements.

As can be appreciated, these techniques are versatile and can be used to fabricate any of a variety of geometries in accordance with embodiments of the invention. The casting of gears is particularly well-suited to harness the advantages achieved by low pressure casting techniques, and the casting of gears is now described in greater detail.

The Low Pressure Casting of Gears

Figure 9A:
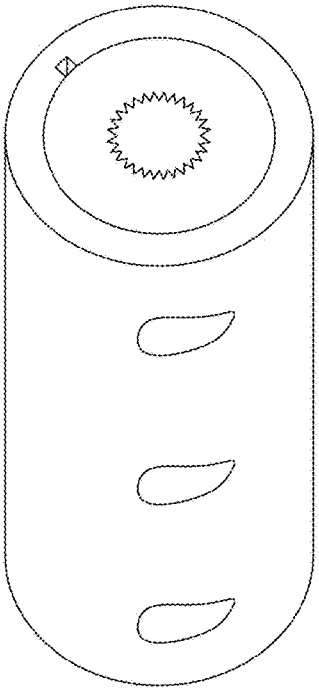
FIGS. 9A-9C illustrate fabricating a gear using a low pressure casting technique in accordance with an embodiment of the invention.
Figure 9B:
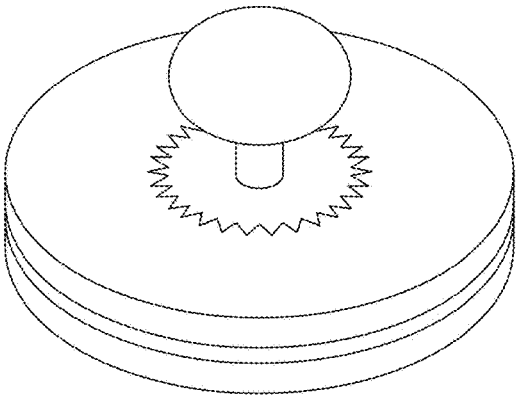
Figure 9C:
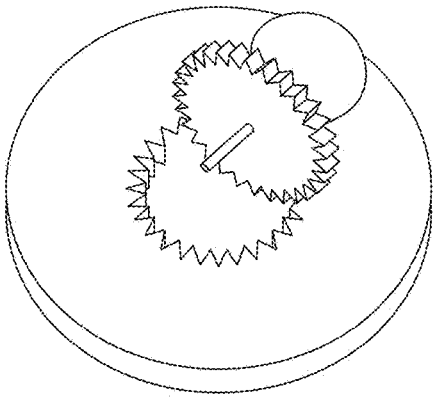

The above described techniques are suitable to advantageously fabricate any of a variety of geometries. In many embodiments, the described low pressure casting techniques are used to fabricate gears. For example, FIGS. 9A-9C depict the fabrication of gears using a low pressure casting technique in accordance with an embodiment of the invention. In particular, FIG. 9A depicts the gear mold used to fabricate the gear disposed within a suction molding arrangement; FIG. 9B depicts the molten alloy having been suction cast into the gear mold, and FIG. 9C depicts the removal of the cast gear from the gear mold. In particular, the gear was suction cast so as to cause the low pressure casting as described above. As a result, the cast part includes a smooth surface finish and is easily removed from the mold.

Figure 10A:
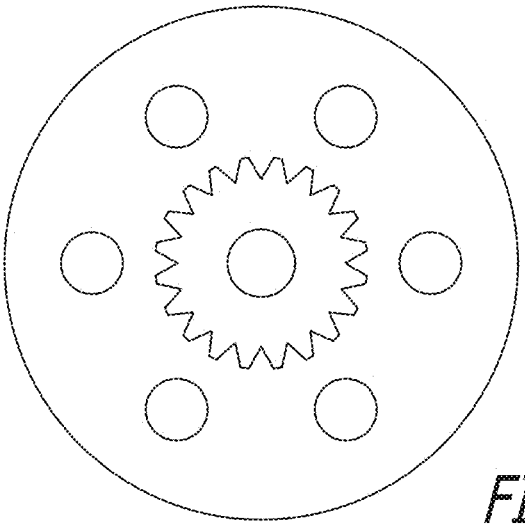
FIGS. 10A-10B illustrate how a cast part can be easily removed from a mold when using a low pressure casting technique in accordance with an embodiment of the invention.
Figure 10B:
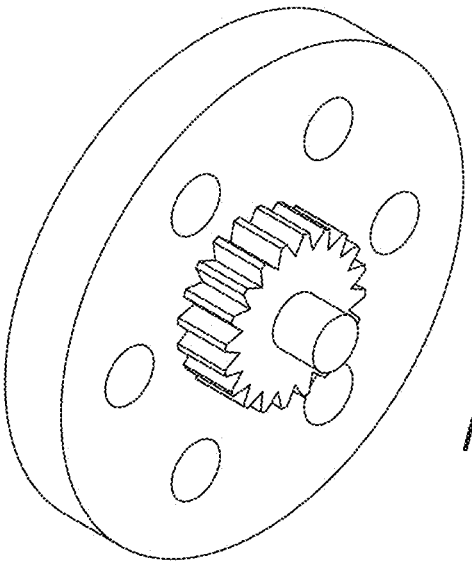

FIGS. 10A-10B highlight that gear molds can be made to have extrusion symmetry, such that the cast gear can be easily ejected from the mold. In particular, FIG. 10A depicts a gear mold that has extrusion symmetry, including a cast metallic glass-based material that has yet to be ejected. More specifically, the molten alloy was introduced into the mold at 5 psi. FIG. 10B depicts easily ejecting the cast metallic glass-based material using a finger. The extrusion symmetry in conjunction with the low pressure casting enable the cast component to be easily ejected using only light pressure from a human finger.

Figure 11:
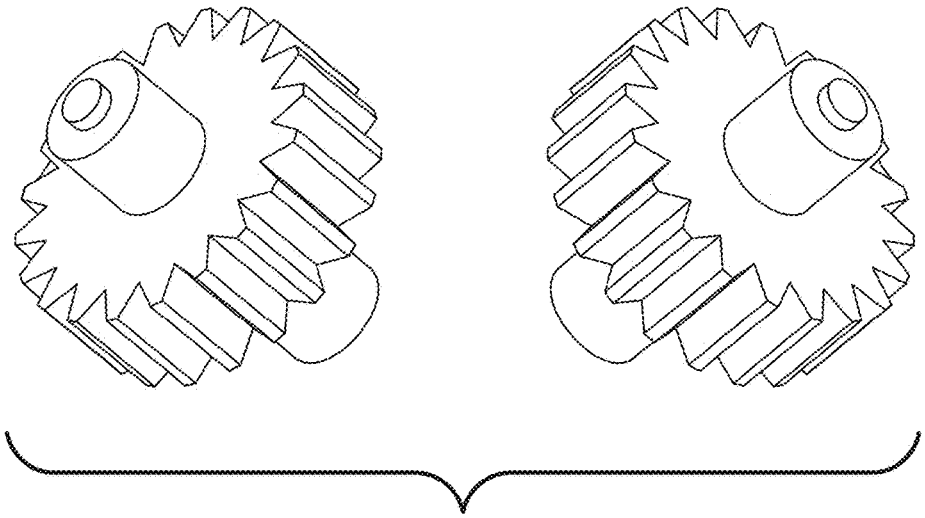
FIG. 11 illustrates how the pressure under which molten alloy is introduced into a mold cavity can be tuned to influence the characteristics of the cast part in accordance with certain embodiments of the invention.

Note that the pressure under which the molten alloy is introduced into the mold can be tuned to obtain the desired geometry in accordance with embodiments of the invention. For example, where more conformity with the mold geometry is desired, a relatively higher pressure can be applied. Contrariwise, where less conformity with the geometry of the mold cavity is desired, the molten alloy can be introduced into the mold at a relatively lower pressure. FIG. 11 depicts a cast gear that was formed using relatively higher pressure (shown on the left) compared to a gear that was cast using relatively lower pressure (shown on the right). In particular, the gear that was cast at a relatively higher pressure more rigidly conforms to the shape of the mold cavity whereas the gear that was cast at a relatively lower pressure more loosely conforms to the shape of the mold. Thus, the pressure at which molten alloy is introduced into a mold cavity can be tuned to influence the characteristics of the cast part.

Figure 12A:
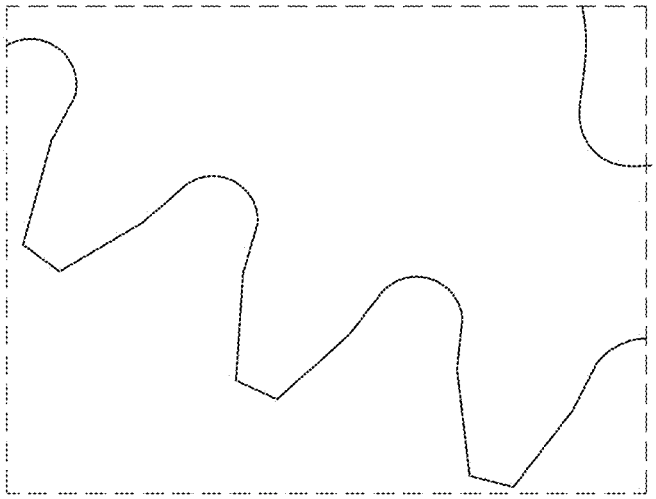
FIG. 12A-12B illustrate how the geometry of a gear formed using conventional fabrication processes compares to the geometry of a gear formed using a low pressure casting technique in accordance with an embodiment of the invention.
Figure 12B:
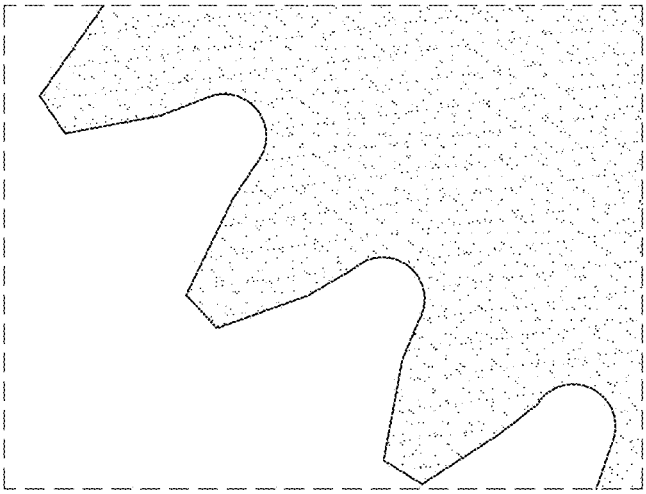

It should be clear that the molten alloy can still be made to substantially conform to the geometry of a mold cavity to a desired extent even when cast under low pressure. For example. FIGS. 12A and 12B depict micrographs of cast gears that demonstrate that the described low pressure casting techniques can still enable molten alloy fully conform to the geometry of the mold cavity—specifically, FIG. 12A depicts a steel gear cast under a conventional high pressure casting technique, while FIG. 12B depicts a metallic glass-based material that was cast in accordance with the low pressure casting techniques described herein. Note that even where low pressure casting techniques as described herein are implemented, the metallic glass-based material can be made to replicate the overall shape of the gear.

Figure 13A:
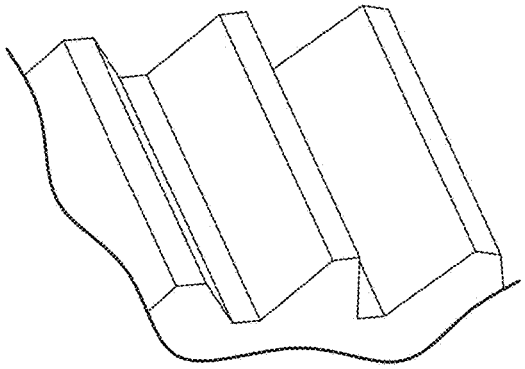
FIGS. 13A-13D illustrate how the surface finish of gears cast using conventional fabrication techniques compare with a gear cast using a low pressure casting technique in accordance with an embodiment of the invention.
Figure 13B:
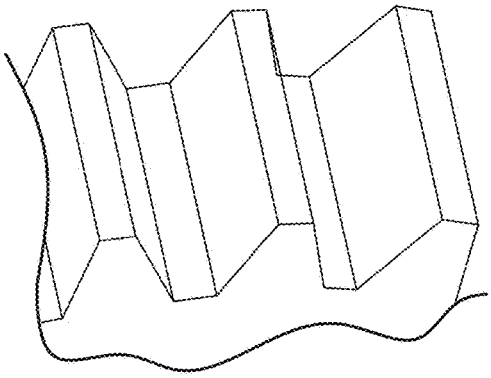
Figure 13C:
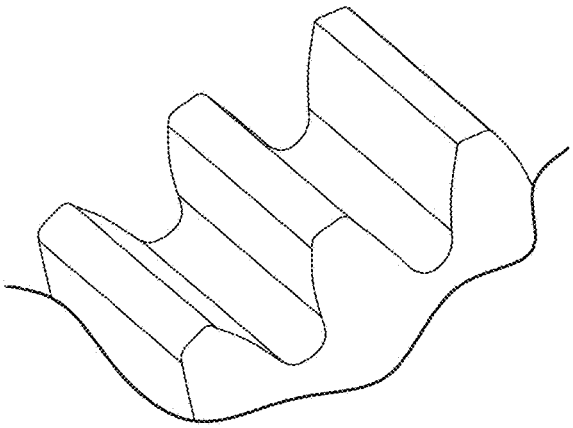
Figure 13D:
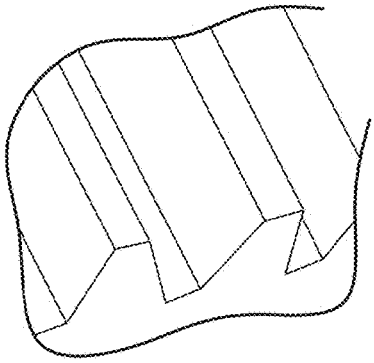
Figure 14:
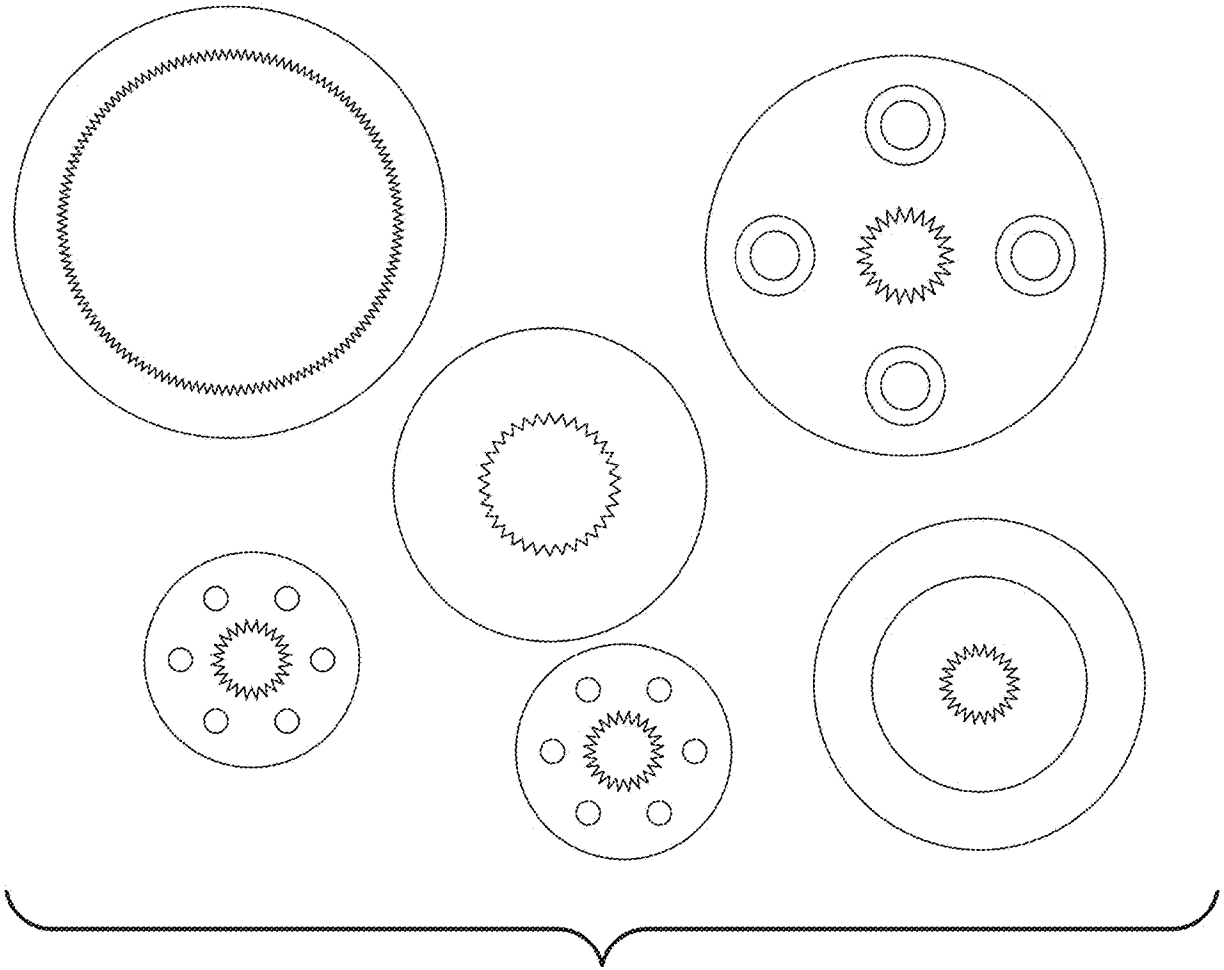
FIG. 14 illustrates a number of molds that can be used in accordance with certain embodiments of the invention.

Importantly, as mentioned previously, low pressure casting techniques in accordance with many embodiments of the invention can allow the surface finish of the cast part to be made relatively smooth. In general, the surface tension within the melt can facilitate the creation of a smooth finish. By way of example, FIGS. 13A-13D depict the surface finishes of parts cast according to various techniques. In particular, FIG. 13A depicts a steel gear, the teeth of which were fabricated via electrical discharge machining (EDM). FIG. 13B depicts a steel gear, the teeth of which were fabricated via conventional machining; FIG. 13C depicts a metallic glass-based gear, the teeth of which were fabricated via EDM, and FIG. 13D depicts a metallic glass-based gear cast under low pressure conditions in accordance with an embodiment of the invention. Note that each of FIGS. 13A-13C depict gears having more of a rough surface finish than that seen in FIG. 13D. Importantly, as mentioned previously, a smooth surface finish can facilitate the operation of a gear as the smooth surface finish can reduce the adverse impacts of wear and tear that the gear may experience. Of course, it should be clear that any of a variety of molds can be used. For example, FIG. 14 depicts several molds which can be used to shape gears using low pressure casting techniques in accordance with embodiments of the invention. More generally, the above-described methods can be used to fabricate any of a variety of geometries, and are not limited to the manufacture of gears.

Figure 15A:
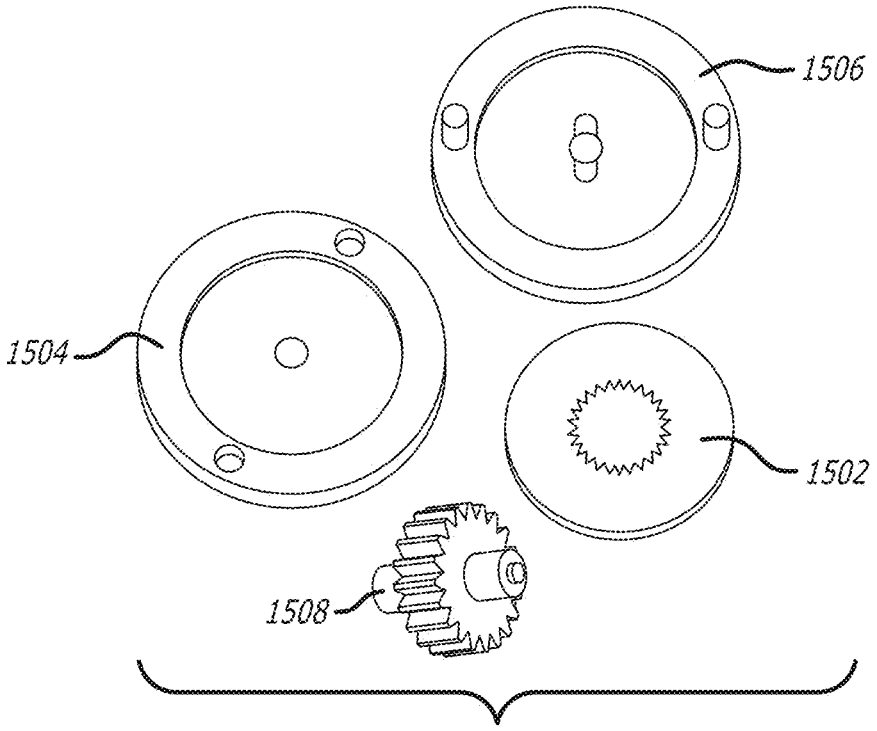
FIGS. 15A-15E illustrate a process for forming gears using a three piece mold in conjunction with a low pressure casting technique in accordance with an embodiment of the invention.
Figure 15B:
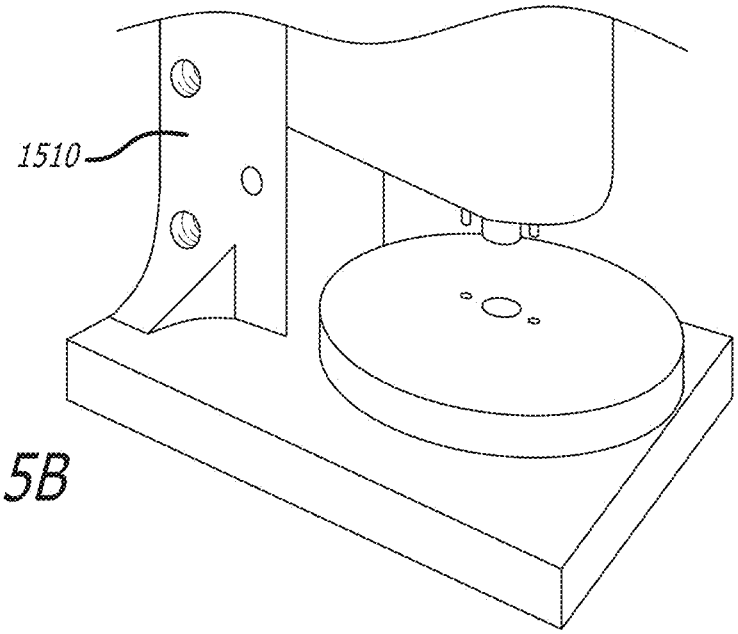
Figure 15C:
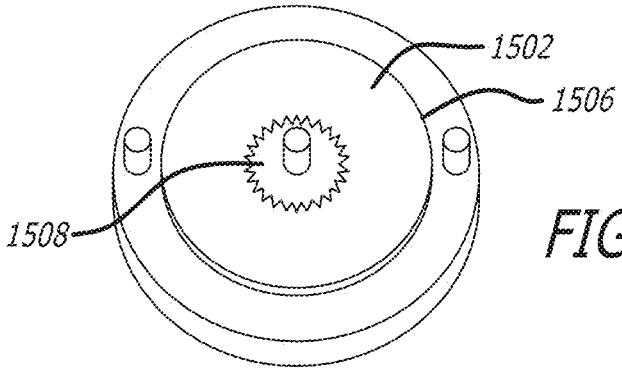
Figure 15D:
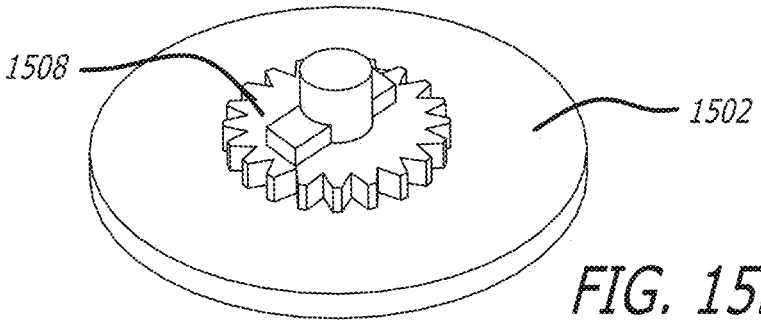
Figure 15E:
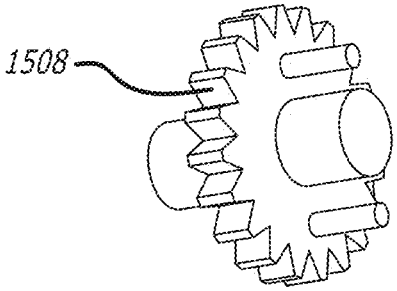

The above-described techniques can be implemented using any of a variety of arrangements. For example, FIGS. 15A-15E depict fabricating a gear using a 3-piece mold. In particular, FIG. 15A depicts a 3-piece mold in conjunction with a cast gear. More specifically, the mold includes a primary piece 1502, and top and bottom pieces 1504 and 1506. The resulting cast gear 1508 is also depicted. FIG. 15B depicts an apparatus 1510 that is used to eject the cast part from the mold. FIG. 15C depicts the bottom portion of the mold 1506, the primary piece of the mold 1502, and the cast gear 1508. FIG. 15D depicts the primary piece of the mold 1502 in conjunction with the cast gear 1508. FIG. 15E depicts the cast gear 1508.

Figure 16A:
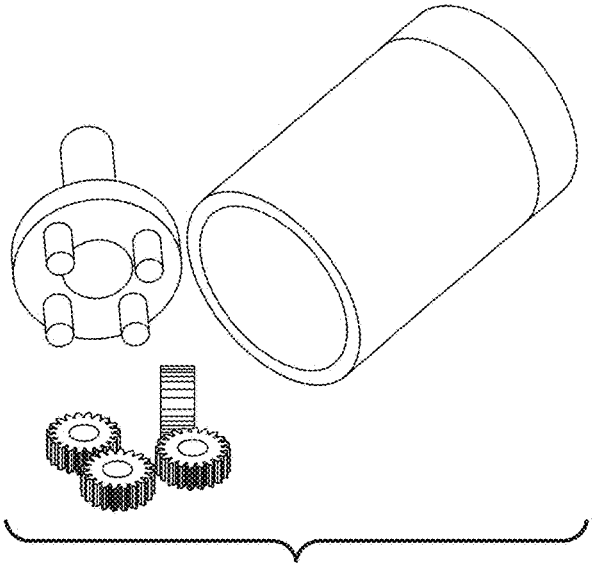
FIGS. 16A-16C illustrate planetary gears that have been fabricated using a low pressure casting technique in accordance with an embodiment of the invention.
Figure 16B:
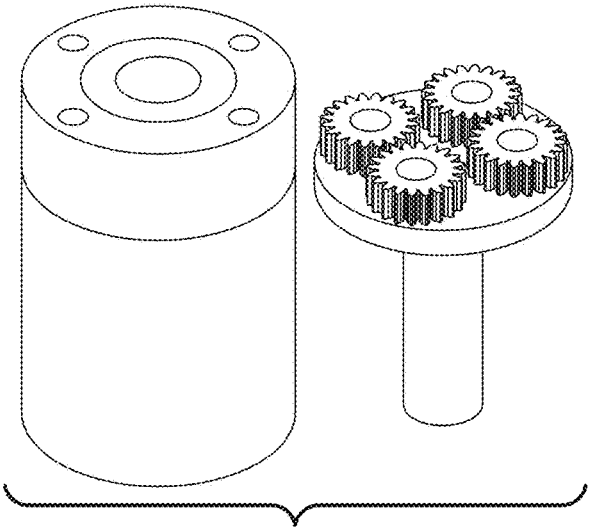
Figure 16C:
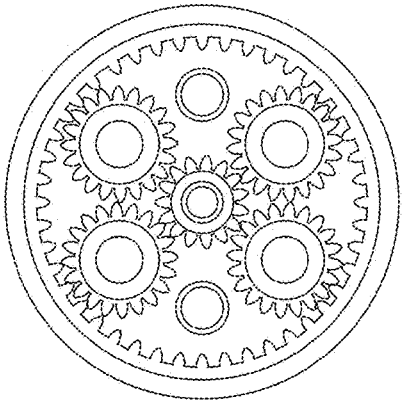

The above-described fabricated gears can be utilized in any of a variety of ways. For example, FIGS. 16A-16C depict that the gears are being implemented in a planetary gear system. In particular, FIG. 16A depicts the components of the planetary gear system, FIG. 16B provides the scale for the planetary gear system, and FIG. 16C depicts the assembled planetary gear system. Of course, it should be clear that gears fabricated in accordance with the described low pressure casting techniques can be implemented in any of a variety of ways in accordance with embodiments of the invention. Indeed, the above-described techniques are broad and can be used to fabricate any of a variety of geometries and are not limited to the fabrication of gears.

More generally, as can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What claimed is:

1. A method of fabricating an object that includes a metallic glass-based material comprising:

introducing a molten metallic glass forming alloy into a mold cavity defined by a mold body having one or more mold features wherein at least one mold feature has a feature size of less than 100 μm under a pressure selected such that the molten metallic glass forming alloy does not conform to the at least one mold feature of the mold cavity smaller than 100 μm; and cooling the molten metallic glass forming alloy such that it solidifies to form a solid comprising a metallic glass-based material.

2. The method of claim 1, wherein the mold cavity is characterized by extrusion symmetry.

3. The method of claim 1, wherein the entirety of the solid comprises a metallic glass-based material.

4. The method of claim 1, wherein less than the entirety of the solid comprises a metallic glass-based material.

5. The method of claim 1, wherein one or more cooling jets are used to cool the molten metallic glass forming alloy such that it solidifies into the solid.

6. The method of claim 1, wherein introducing the molten metallic glass forming alloy into the mold cavity comprises using gas to force the molten metallic glass forming alloy into the mold cavity under the pressure.

7. The method of claim 1, wherein introducing the molten metallic glass forming alloy into the mold cavity comprises using at least a partial vacuum to create a pressure differential that causes the molten metallic glass forming alloy to be drawn into the mold cavity.

8. The method of claim 1, wherein introducing the molten metallic glass forming alloy into the mold cavity comprises using a hydraulic ram to apply the pressure to the molten metallic glass forming alloy and thereby introduce it into the mold cavity.

9. The method of claim 1, wherein introducing the molten metallic glass forming alloy into the mold cavity comprises pouring the molten metallic glass forming alloy into the mold cavity.

10. The method of claim 9, wherein introducing the molten metallic glass forming alloy into the mold cavity further comprises using at least a partial vacuum to cause a pressure differential that causes the molten metallic glass forming alloy to be drawn into the mold cavity under the pressure.

11. The method of claim 9, wherein introducing the molten metallic glass forming alloy into the mold cavity further comprises using a piston to apply a force to the molten metallic glass forming alloy causing the molten metallic glass forming alloy to be compelled into the mold cavity under the pressure.

12. The method of claim 1, wherein the mold cavity defines the shape of a gear.

13. A method of fabricating an object that includes a metallic glass-based material comprising:

introducing molten metallic glass forming alloy into a mold cavity defined by a mold body having one or more mold features wherein at least one mold feature has a feature size of less than 100 μm using a pressure of less than approximately 100 psi such that the molten metallic glass forming alloy does not conform to the at least one mold feature of the mold cavity smaller than 100 μm; and cooling the molten metallic glass forming alloy at a rate such that the metallic glass forming alloy develops an amorphous structure and solidifies to form a solid comprising a metallic glass-based material.

14. The method of claim 13, wherein the pressure is less than approximately 15 psi.

15. The method of claim 14, wherein the pressure is less than approximately 5 psi.

16. The method of claim 13 wherein the mold cavity is characterized by an extrusion symmetry.

17. The method of claim 13, wherein the entirety of the solid comprises the metallic glass-based material.

18. The method of claim 13, wherein less than the entirety of the solid comprises the metallic glass-based material.

19. The method of claim 13, wherein at least two cooling jets are used to cool the molten metallic glass forming alloy.

20. The method of claim 13, wherein introducing the molten metallic glass forming alloy into the mold cavity comprises using a gas to force the molten metallic glass forming alloy into the mold cavity under the pressure.

21. The method of claim 13, wherein introducing the molten metallic glass forming alloy into the mold cavity comprises using at least a partial vacuum to cause a pressure differential that causes the molten metallic glass forming alloy to be drawn into the mold cavity.

22. The method of claim 13, wherein introducing the molten metallic glass forming alloy into the mold cavity comprises using a hydraulic ram to apply the pressure to the molten metallic glass forming alloy and thereby introduce it into the mold cavity.

23. The method of claim 13, wherein introducing the molten metallic glass forming alloy into the mold cavity comprises pouring the molten metallic glass forming alloy into the mold cavity.

24. A method of fabricating an object that includes a metallic glass-based material comprising:

introducing a molten alloy into a mold cavity defined by a mold having one or more mold features wherein at least one mold feature has a feature size of less than 100 μm under a pressure selected such that the molten alloy does not conform to the at least one mold feature of the mold cavity smaller than 100 μm; and cooling the molten alloy such that it solidifies to form a solid, wherein the entirety of the solid comprises a metallic glass-based material.

* * * * *